US005950884A

United States Patent [19]

Payne

[11] Patent Number: 5,950,884

[45] Date of Patent: Sep. 14, 1999

[54] SUSPENDER HANGING ASSEMBLY

[76] Inventor: Wyatt Payne, 1467 N.W. 74th St., Miami, Fla. 33147

[21] Appl. No.: 09/045,997

[22] Filed: Mar. 23, 1998

[51] Int. Cl.[6] ..... A47G 25/14

[52] U.S. Cl. ..... 223/85

[58] Field of Search ..... 223/85, 92, DIG. 1, 223/DIG. 2; D6/315, 328; 211/113

[56] References Cited

U.S. PATENT DOCUMENTS

| | | | |
|---|---|---|---|
| 33,069 | 8/1861 | Ross | D6/315 |
| D. 394,557 | 5/1998 | Wilcox | D6/318 |
| 4,714,156 | 12/1987 | Kolton et al. | 206/296 |
| 4,759,440 | 7/1988 | Kolton et al. | 206/296 |
| 5,421,465 | 6/1995 | Dunner, Jr. | 211/115 |
| 5,642,841 | 7/1997 | Beaty | 223/85 |

*Primary Examiner*—Bibhu Mohanty

*Attorney, Agent, or Firm*—Malloy & Malloy, P.A.

[57] ABSTRACT

A hanger assembly specifically designed for the removable support and display of suspenders particularly of the type structured to be secured to pants or trousers by buttons and including apertured, button attachment members movably secured to the extremities of the shoulder straps and back strap of the suspender. The hanger assembly includes a base portion having an attachment element extending outwardly and preferably upwardly therefrom so as to be removably supported on a horizontal mounting support or the like. A primary support is also included on said base portion and includes oppositely disposed surfaces and a plurality of support fingers extending outwardly therefrom wherein the support fingers are arranged in groups of preferably three support fingers each extending outwardly from both the opposite surfaces and structured to removably engage the apertured button attachment members at the extremities of the suspender so a to support the suspender thereon in a somewhat looped configuration.

8 Claims, 3 Drawing Sheets

FIG. 5
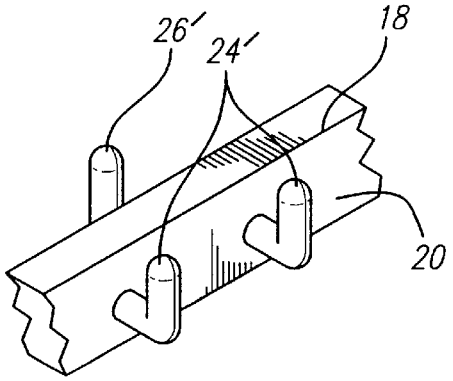
FIG. 9
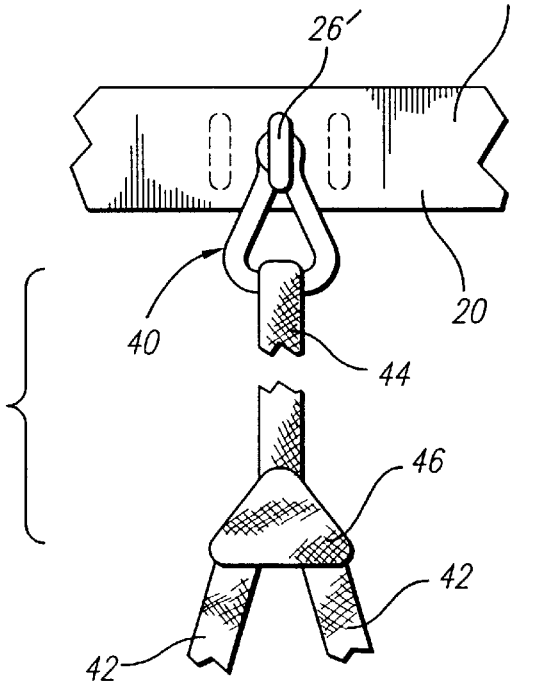
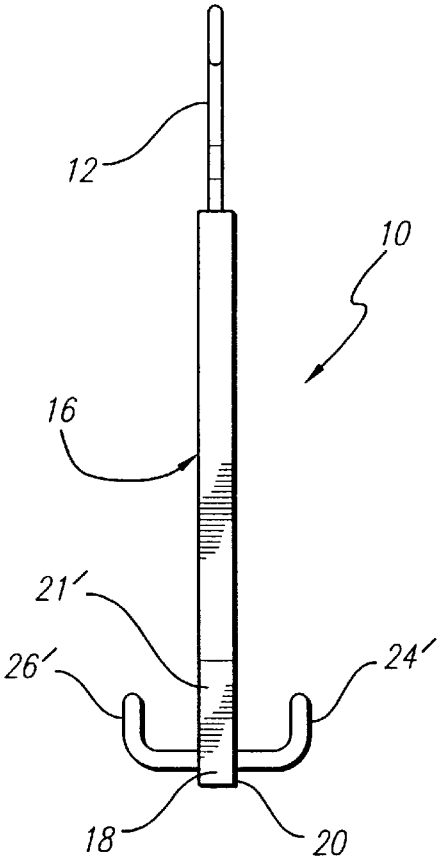
FIG. 6
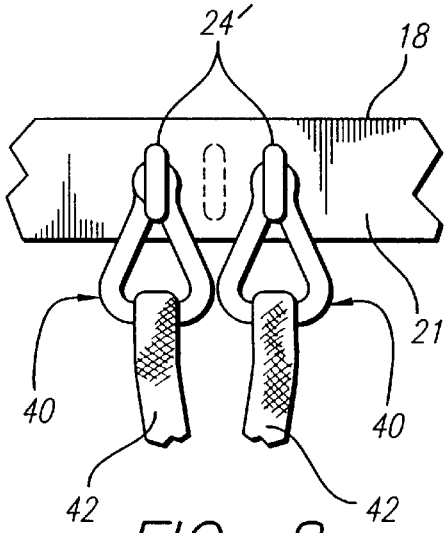
FIG. 8

SUSPENDER HANGING ASSEMBLY

BACKGROUND OF THE INVENTION

1. Field of the Invention

A suspender hanger assembly designed to removably support and display button-attached suspenders in a generally looped, space saving, and organized configuration, in order to avoid the conventional folding or alternately the vertically oriented straight line hanging of suspenders during storage.

2. Description of the Related Art

The wearing of suspenders for the support of trousers or pants has, of course, been known for many years. In recent years, however, the use of suspenders or "braces" have enjoyed increasing popularity due in part to the wide variety of creative and colorful designs available to the consuming public. Indeed, while suspenders have traditionally been considered a masculine article of clothing, recent fashion trends include the wearing of suspenders by women as well as men.

Generally, suspenders are available in two different styles. The first includes two shoulder straps and one or two back straps wherein each of the straps has a spring biased clip or like structure used to grip the upper peripheral edge of the trousers or pants being supported generally in the area of the waistband. The clips located at the extremity of each strap are structured to grippingly engage both the exterior and interior surfaces adjacent the upper peripheral edge of the waistband and do not require any type of buttons or like connectors to secure the clips to the pants being supported. The second and perhaps the most popular style of suspender available, however, includes two shoulder straps each having an apertured or slotted button-attachment member located at the free extremity thereof. Moreover, the opposite, fixed end of the shoulder straps meet at a junction pad or like connecting member which further includes a back strap disposed in depending relation therefrom. The back strap also includes one apertured or slotted button-attachment member movably attached to the free end thereof. Accordingly, each of the three button-attachment members movably secured to the outermost or free end of each of the aforementioned straps are designed to be removably attached to the interior surface of the waistband by means of buttons correspondingly located on the interior surface. The slots or apertures formed in the button engaging members are specifically configured and dimensioned to removably receive the buttons therethrough for attachment of the suspenders in the desired supporting position.

The button-attached suspenders, of the type described above, are generally considered to be more expensive due to the workmanship and material utilized in their manufacture. Accordingly, additional care is normally taken in their storage when such suspenders are not being worn. Numerous hangers or support devices are known and have been designed specifically for the storage and display of suspenders of both types set forth above. However, certain disadvantages are prevalent and well recognized in utilizing these known devices. Typical structuring of such devices involve the support of suspenders by draping the main strap portions of the suspenders in a folded over orientation such that inadvertent removal of the suspenders from the support device is a frequent and common occurrence. In addition, the storing of suspenders in a folded orientation frequently results in creases or wrinkles developing in the length of the shoulder straps which results in an unsightly and undesirable appearance of the suspenders when worn.

Other known structures for the storage of suspenders include a conventional clothes hanger wherein one end of the suspenders are attached to some supporting portion thereof and the suspenders are allowed to extend vertically along their entire length. Some disadvantages that are associated with this type of storage is that the lowermost end of the supported suspenders frequently come in contact with the floor adjacent the storage area. Yet other mounting facilities for storing suspenders, when not in use, involves a structure which can be combined at a tie and suspender holder. Such a structure normally includes a number of outwardly extending, spaced apart prongs disposed for supporting engagement with suspenders through removable attachment to an end portion thereof. Unfortunately, the suspenders can easily become dislodged and are not as accessible when co-mingled with ties. Furthermore, wherein the suspenders are loosely positioned, draped or folded over one or more of the prongs, the same problems and disadvantages associated with other known structures set forth above nevertheless remain.

Accordingly, there is a need for an efficient and effective suspender hanger assembly that is specifically designed to removably support and display button-attached suspenders in a manner which eliminates the tendency for inadvertent removal of the suspenders and also maintains the suspenders in an appropriate, suspended orientation to eliminate creases or wrinkles being formed therein. Such a preferred suspender hanger assembly should also eliminate the need to mount or support suspenders in a completely vertical orientation along their length such that the lowermost, free end thereof frequently engages the floor, shoes or other articles positioned in the storage area. In addition, such a preferred suspender hanger assembly should also allow for the effective display of such button-attached suspenders to facilitate the selection thereof by orienting the stored suspenders for adequate visual inspection.

SUMMARY OF THE INVENTION

The present invention relates to a suspender hanger assembly specifically designed to removably mount button-attached suspenders in a manner which allows the suspenders to be oriented in a generally looped configuration thereby eliminating or significantly reducing the possibility of wrinkling or creasing during storage. More specifically, the subject hanger assembly comprises a base portion having an attachment member, preferably in the form of a mounting hook extending outwardly from an upper portion thereof. The attachment hook is disposed and configured to engage a conventional, horizontally oriented mounting bar or the like typically found in closets for the support of a plurality of clothes hangers. The base portion may assume a variety of configurations and dimensions, but preferably includes a primary support portion formed thereon. The primary support portion is specifically structured to include two exposed, substantially oppositely oriented surfaces and preferably has an elongated configuration.

A plurality of support fingers are formed on the primary support portion so as to extend outwardly from the opposite surfaces thereof. The fingers on each of the opposite surfaces are disposed in a predetermined spaced relation to one another such that the plurality of fingers are arranged in spaced apart groups of a predetermined number of cooperatively oriented support fingers structured and disposed to removably support a suspender in the aforementioned substantially looped configuration. In a preferred embodiment, to be described in greater detail hereinafter, each of the fingers are configured and structured to engage the button-attachment members secured to extremities of each of the shoulder straps and back strap of a suspender. More specifically, each of the support fingers of each group is dimensioned to pass through both of the apertured ends of the button-attachment member secured to each of the extremities of the various straps of the supported suspender. Further, each of the support fingers is specifically configured and otherwise structured to resist inadvertent detachment of the button-attachment members therefrom. Accordingly, each of the support fingers may extend outwardly from one of the two opposite surfaces and may be in the form of a hook-shape or more specifically an L-shaped hook which is dimensioned to facilitate mounting of the button-attachment members on the various support fingers but reduces the possibility of inadvertent removal therefrom.

In one preferred embodiment of the present invention, each group of support fingers are defined by three such support fingers wherein each group includes two support fingers extending outwardly from a common surface in spaced apart relation to one another. A third of the three support fingers of each group is secured to and extends outwardly from the other of the two opposite surfaces and is disposed generally intermediate to the two fingers. Preferably the third finger is disposed midway therebetween but extends in a substantially opposite direction. By virtue of this arrangement, each group comprising three support fingers, is specifically structured to allow the button-attachment members secured to the free ends of the shoulder straps to be respectively secured to the two support fingers extending outwardly from one of the opposite surfaces. The button-attachment member connected to the free end of the back strap is attached to the one support finger secured to and extending outwardly from the other of the two opposite surfaces of the primary support. By virtue of this cooperative arrangement of each of the support fingers in any one group, the aforementioned preferred loop type configuration during storage of the mounted suspenders is efficiently accomplished. In order to accommodate a reasonable number of suspenders being supported from the same hanger assembly, a plurality of groups of three support fingers each are disposed in spaced relation to one another along the length of the primary support portion such that the stored suspenders may be displayed for visual examination in a side by side orientation.

Accordingly, it is a primary object of the present invention to provide a hanger assembly designed to removably support button-attached suspenders therefrom in a manner which will eliminate wrinkling or creasing of the suspenders during storage.

Another primary object of the present invention is to provide a hanger assembly which serves to removably support button-attached suspenders in a substantially looped orientation.

Yet another important object of the present invention is to provide a hanger assembly designed to removably support button-attached suspenders incorporating structural components which provide for easy attachment of the suspenders thereto but eliminates or significantly reduces the possibility of inadvertent detachment therefrom.

Still another important object of the present invention is to provide a hanger assembly designed to support a plurality of button-attached suspenders in a side-by-side relation to one another without the crowding of adjacently positioned suspenders and which allows the comparative visual inspection of the plurality of suspenders to facilitate selection thereof.

It is also an important object of the present invention to provide a hanger assembly designed to removably support button-attached suspenders which is structured to be removably connected to one of any number of conventional mounting bars found in a clothes closet or like storage area.

Yet another object of the present invention is to design a hanger assembly for the removable support of button-attached suspenders which is simple yet effective in design, long lasting and cost effective for manufacture.

These and other objects, features and advantageous of the present invention will become more clear when the drawing as well as the detailed description are taken into consideration.,

BRIEF DESCRIPTION OF THE DRAWINGS

For a fuller understanding of the nature of the present invention, reference should be had to the following detailed description taken in connection with the accompanying drawings in which:

FIG. 5 is a detailed view of structural components of the present invention shown in perspective and partial cutaway.

FIG. 6 is an end view of the embodiment of FIG. 5.

FIG. 8 is a front view in partial cutaway with button-attached suspenders mounted on the suspender hanger assembly of the present invention.

FIG. 9 is a rear view of the embodiment of FIG. 8.

Like reference numerals refer to like parts throughout the several views of the drawings.

DETAILED DESCRIPTION OF THE PREFERRED EMBODIMENT

Figure 1:
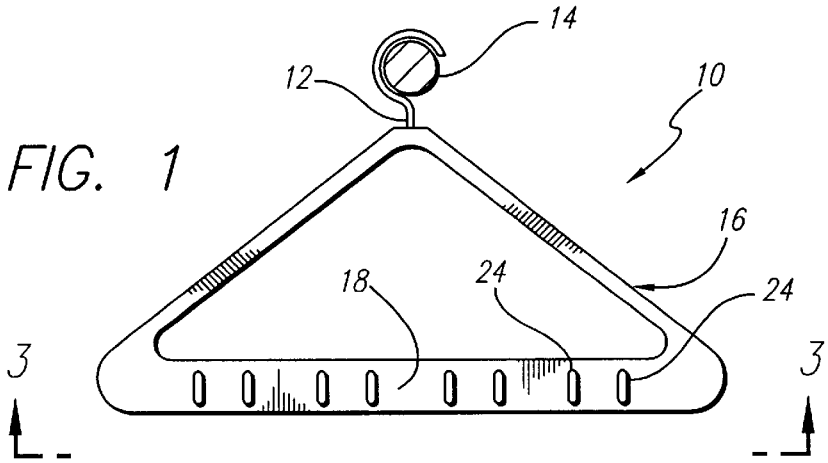
FIG. 1 is a front plan view of one preferred embodiment of the suspender hanger assembly of the present invention.
Figure 2:
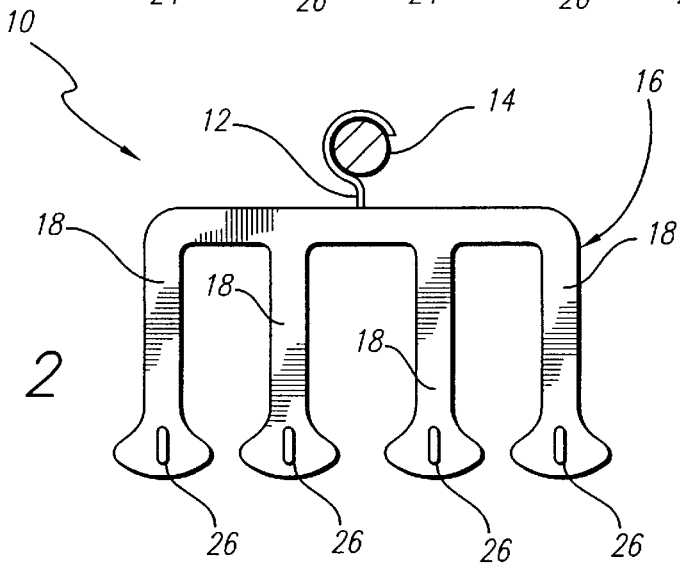
FIG. 2 is a rear view of another embodiment of the present invention.
Figure 7:
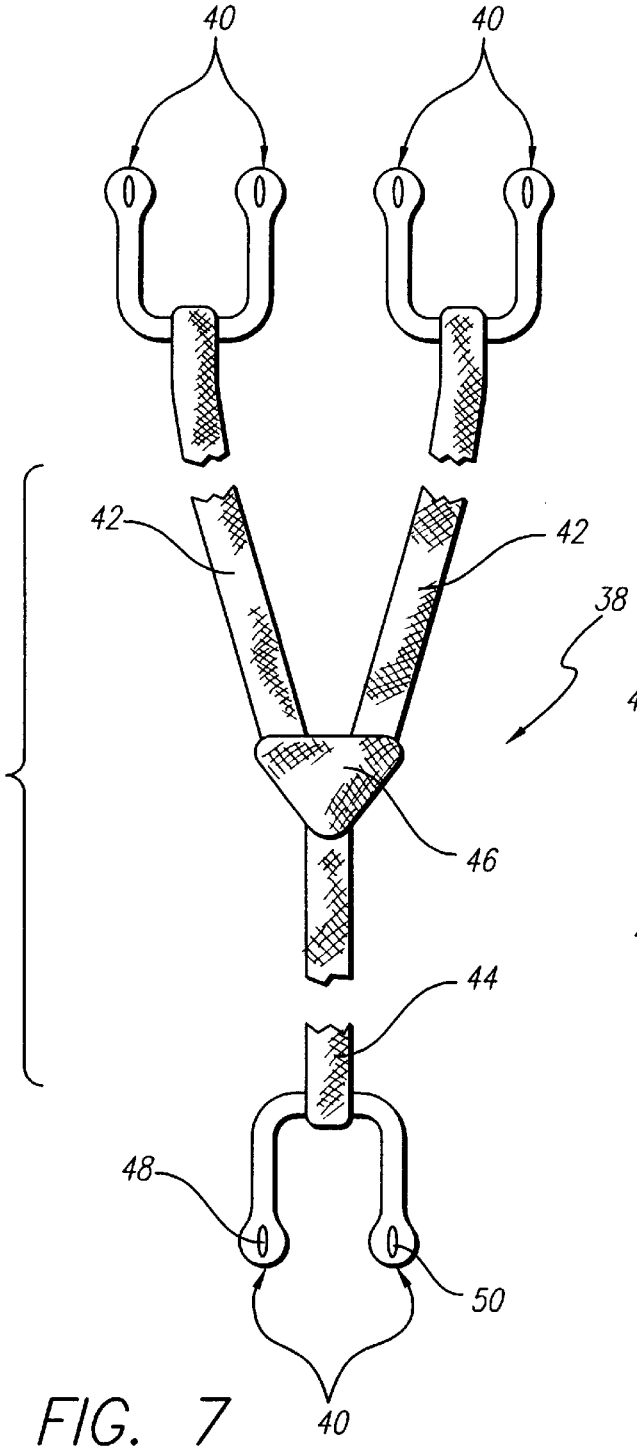
FIG. 7 is a detailed view in partial cutaway and perspective of portions of a button-attached suspender.

As shown in the accompanying Figures, the present invention is directed towards a suspender hanger assembly, generally indicated at 10. The suspender hanger assembly 10 includes an attachment member 12, preferably in the form of a connecting or attachment element, such as a hook which is designed to removably engage any, conventional type of mounting support as at 14 of the type typically found in clothes closets. The suspender hanger assembly 10 further includes a base portion as at 16 wherein the attachment hook 12 extends outwardly from an upper portion thereof. As shown in FIGS. 1 and 2, the base portion 16 may take a variety of varying configurations and dimensions but includes as an important feature of the present assembly a primary support portion 18. The primary support 18, which can include a large panel or one or more smaller segments, is structured to include two oppositely exposed surfaces as at 20 and 21 which, are cooperatively disposed and structured, with the placement of the attachment hook 12, so as to be normally disposed in a substantially horizontal orientation when the attachment hook 12 and accordingly the base portion 16 are supported by the mounting support 14.

Figure 10:
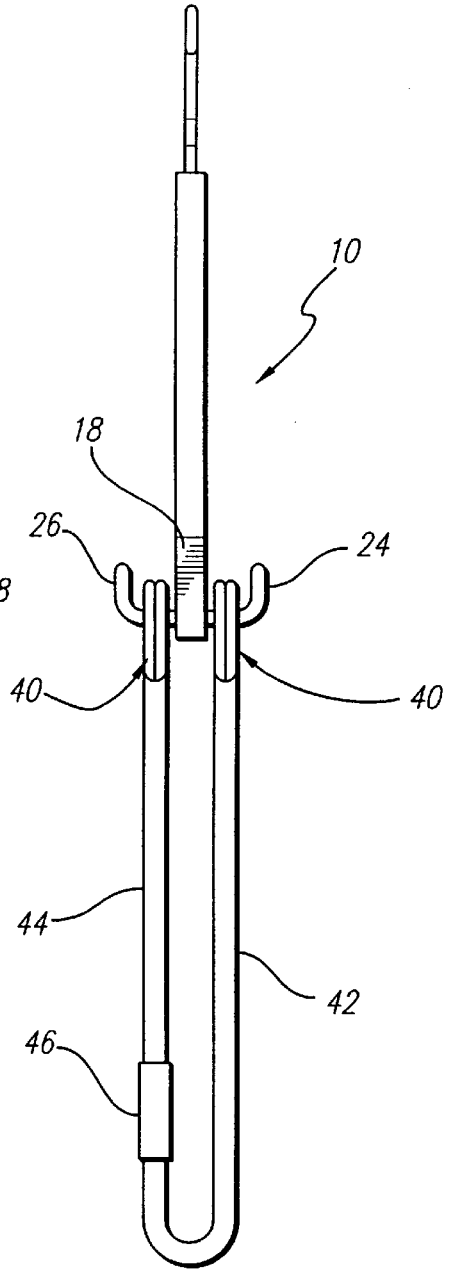
FIG. 10 is an end view of a button-attached suspender mounted on the suspender hanger assembly of the present invention.

An important feature of the present invention is the provision of a plurality of support fingers 24 and 26 secured to the base portion 16 and more particularly extending outwardly from both of the opposite surfaces 20 and 21 of the primary support 18. The plurality of support fingers 24 and 26 are arranged in groups wherein each group comprises a predetermined number of cooperatively disposed, configured and structured fingers which removably support a button-attached suspender assembly 38 on the primary support 18 in a generally looped configuration, as best shown in FIG. 10. This orientation of the suspender assembly 38, when being stored, will reduce or completely eliminate the possibility of wrinkling or creasing regardless of the length of the time storage time between uses.

The suspender assembly 38 is specifically of the button-attached type and includes a pair of shoulder straps 42 and at least one back strap 44 wherein fixed ends of the straps 42 and 44 are secured at a common junction pad 46. In conventional fashion, the suspender 38 is attached in supported relation to pants or trousers by the provision of button-attachment members 40 secured to the free ends of each of the shoulder straps 42 and back strap 44 as shown in FIGS. 7–10. Each of the button-attachment members 40 includes an elongated somewhat curvilinear configuration formed of leather or other applicable, flexible material and has apertures or slots 48 and 50 formed in opposite longitudinal ends thereof. Accordingly, each of the support fingers 24 and 26 are specifically configured and structured to facilitate attachment of the button-attachment members 40 thereto by passing each of the support fingers 24 and 26 through at least one but preferably both of the apertures or slots 48 and 50 in one of the button-attachment members 40 in a manner best shown in FIGS. 8 and 9. Each of the two first support fingers 24 of each group are designated to support the button-attachment members 40 of the shoulder straps 42.

Therefore, each of the plurality of groups into which the plurality of support fingers 24 and 26 are arranged are more specifically defined by two spaced apart front support fingers 24' and 24' (See FIG. 5) extending outwardly from a common surface 20. A third rear one of the support fingers 26' extends outwardly from the opposite surface as at 21. Further, the various support fingers of the same group are all preferably disposed in parallel relation to one another and the single rear support finger 26' is preferably disposed generally intermediate the other two front support fingers 24' and preferably midway therebetween so as to comfortably position and support the button-attachment member 40 secured to the free end of the back strap 44 as best shown in FIGS. 8 and 9.

Figure 3:
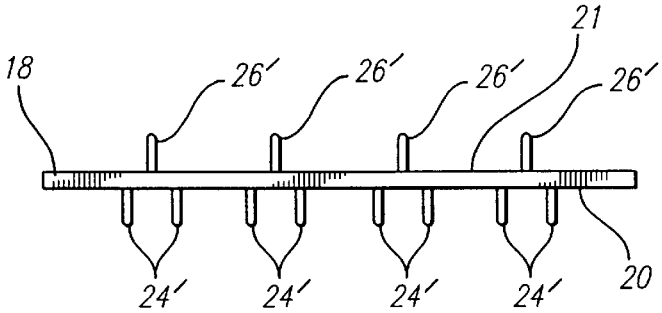
FIG. 3 is a end view along lines 3—3 of FIG. 1.
Figure 4:
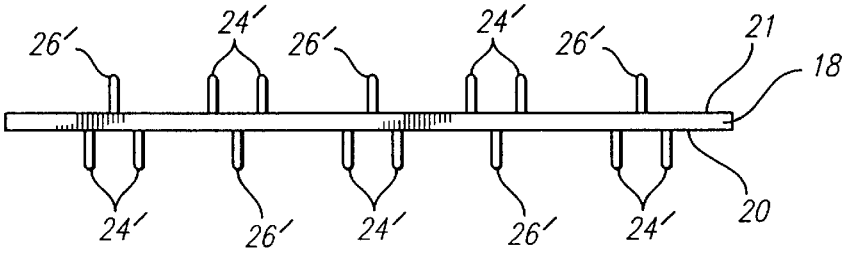
FIG. 4 is another embodiment differing from but similar to that of FIG. 3.

With reference to FIGS. 3 and 4, the elongated configuration of the primary support 18 allows for a plurality of such groupings, wherein each group contains three support fingers 24 and 26 in the cooperative disposition as explained above. By virtue of this arrangement, a plurality of suspenders 38 may be disposed in side-by-side relation to one another wherein each supported suspender 38 has a looped configuration during its storage, as shown in FIG. 10.

In one preferred embodiment of the present invention, as best shown in FIG. 3, each of the adjacent groups have the two spaced apart front support fingers 24' disposed on a common surface 20 and accordingly, each of the one rear support fingers 26' is disposed on the opposite of surface 21. Another embodiment of the present invention is shown in FIG. 4 comprises the adjacent groups having the two support fingers 24 disposed on opposite surfaces 20, 21. In this latter embodiment, the plurality of suspenders, supported in the intended fashion may be alternately reversed but be in a closer, adjacent relation to one another so that a larger number of suspenders may be accommodated along a given length of the primary support 18.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A suspender hanger assembly designed to removably support at least one suspender including a pair of spaced apart shoulder straps coupled to one back strap, wherein each of the shoulder straps and one back strap includes an attachment member at an extremity thereof, said suspender hanger assembly comprising:

a) a base portion having an attachment element extending outwardly therefrom and configured to removably engage a mounting support, b) said base portion including a primary support having a substantially elongated configuration and two oppositely disposed surfaces extending along the length thereof, c) said primary support structured and cooperatively disposed relative to said attachment element so as to dispose said opposite surfaces thereof in an exposed position, d) a plurality of support fingers formed on said primary support and arranged in a plurality of substantially spaced apart groups of three support fingers each, e) each of said groups comprising two front support fingers extending outwardly from only one of said opposite surfaces in spaced apart relation from one another and one rear support finger extending outwardly from only the other of said opposite surfaces and disposed generally midway between said two front support fingers, f) each of said plurality of support fingers comprising a substantially L-shaped configuration oriented to restrict inadvertent removal of said attachment member of the one suspender therefrom, g) each of said two front support fingers being disposed and dimensioned to pass through an apertured portion of the attachment member of a different one of the shoulder straps and said one rear support finger being disposed and dimensioned to pass through an apertured portion of the attachment member of the one back strap, and h) said three support fingers of each of said plurality of groups being cooperatively disposed and structured to removably support the suspender in a substantially looped configuration from both of said opposite surfaces.

2. An assembly as recited in claim 1 wherein said attachment element is secured to an upper portion of said base portion.

3. An assembly as recited in claim 2 wherein said attachment element is disposed and oriented to be removably supported on a substantially horizontally oriented mounting support.

4. An assembly as recited in claim 3 wherein said primary support is oriented in depending relation from said attachment element in a normally horizontal orientation.

5. An assembly as recited in claim 1 wherein said plurality of groups extend along at least a majority of the length of said primary support.

6. An assembly as in claim 1 wherein said support fingers of each of said groups are oriented in a substantially parallel relation to one another.

7. An assembly as in claim 1 wherein each of said support fingers of each of said groups is dimensioned and configured to pass through and retain two apertured portions of said attachment member at a different one of said extremities of the suspender.

8. An assembly as in claim 1 wherein said primary support comprises an elongated configuration, said plurality of support fingers arranged in equally said plurality of groups disposed in spaced relation to one another along the length of said primary support.

* * * * *